US006789802B2

(12) United States Patent
Hornia

(10) Patent No.: US 6,789,802 B2
(45) Date of Patent: Sep. 14, 2004

(54) PARTNERING GAME AND METHOD OF PLAYING SAME

(76) Inventor: Osmany Hornia, 9052 NW. 146th Ter., Miami Lakes, FL (US) 33018

( * ) Notice: Subject to any disclaimer, the term of this patent is extended or adjusted under 35 U.S.C. 154(b) by 0 days.

(21) Appl. No.: 09/881,653

(22) Filed: Jun. 14, 2001

(65) Prior Publication Data

US 2002/0190472 A1 Dec. 19, 2002

(51) Int. Cl.[7] ..... A63F 1/00

(52) U.S. Cl. ..... 273/308; 273/138.2; 273/459; 463/1; 463/44

(58) Field of Search ..... 273/138.2, 308, 273/459, 460, 292; 434/236, 237, 238; 463/1, 44

(56) References Cited

U.S. PATENT DOCUMENTS

| | | | | | |
|---|---|---|---|---|---|
| 4,743,031 | A | * | 5/1988 | Lamle | 273/146 |
| 5,054,775 | A | * | 10/1991 | Banks et al. | 273/431 |
| 5,213,509 | A | * | 5/1993 | Gunn | 434/236 |
| 5,775,700 | A | * | 7/1998 | Hornia et al. | 273/459 |
| 6,139,016 | A | * | 10/2000 | Plato | 273/242 |

* cited by examiner

*Primary Examiner*—S. Thomas Hughes
*Assistant Examiner*—Alex F. R. P. Rada, II

(57) ABSTRACT

A new partnering game and method of playing same for enabling male and female players to anonymously select a player of their liking and determining whether or not the selected player likes them in such manner that only a mutually self-selected male-female couple knows of the selection. A method for revealing admirers of the players is also provided.

10 Claims, 5 Drawing Sheets

PARTNERING GAME AND METHOD OF PLAYING SAME

BACKGROUND OF THE INVENTION

1. Field of the Invention

The present invention relates to games and more particularly pertains to an improved partnering game and method of playing same for enabling male and female players to anonymously select a player of their liking and determining whether or not the selected player likes them in such manner that only a mutually self-selected male-female couple knows of the selection. The present invention provides for improvements upon the inventor's partnering game disclosed in U.S. Pat. No. 5,775,700.

2. Description of the Prior Art

The use of games is known in the prior art. The inventor knows of only his U.S. Pat. No. 5,775,700 which discloses a partnering game in which players anonymously select a player of their liking and a mutual selection is confirmed or denied anonymously. To play the game as disclosed in U.S. Pat. No. 5,775,500, each of a plurality of male game players is given a single game token from a first set of game tokens having a distinct indicia thereon and each of a plurality of female game players is given a single game token having a distinct indicia thereon from a second set of game tokens. Each of the male game players and each of the female game players is also given a numbered card key. Each male game player and each female game player then deposit their game token into a numbered token box corresponding to the numbered card key held by a game player of the opposite sex of their desiring. Each male game player and each female game player then retrieves the game tokens from their numbered token boxes by means of their numbered card key. Each male game player and each female game player then place each game token retrieved from the numbered token boxes into the token pocket having an indicia corresponding to the indicia on each retrieved game token and the indicia of the game token originally given to each male game player and each female game player. Any token pocket having tow game tokens therein indicates a potential partnership.

In an improved version of the partnering game in accordance with the present invention, a first set of cards bearing indicia from a first set of indicia, a second set of cards bearing indicia from a second set of indicia, and a third set of cards bearing no indicia are employed as hereinafter described to achieve the objects of selecting a game player of the opposite sex of a game player's liking and confirming or denying a mutual selection or the existence of an admirer. In another preferred embodiment of the invention, a fourth set of cards identical to the first set of cards and a fifth set of cards identical to the second set of cards are employed to achieve the objects of the partnering game.

In yet another improved version of the partnering game in accordance with the present invention, a computerized device is employed as described hereinafter to achieve the objects of the partnering game.

In yet still another improved version of the partnering game in accordance with the present invention, a plurality of devices utilizing infrared signaling are employed to achieve the objects of the partnering game.

In these respects, the partnering game and method of playing same according to the present invention substantially departs from the partnering game of the prior art and in so doing fulfills the purposes of the present invention as defined by the following objectives, disclosure, and claims.

SUMMARY OF THE INVENTION

It is therefore an object of the present invention to provide a new partnering game and method of playing same apparatus and method which has many of the advantages of the inventor's patented invention mentioned heretofore and many novel features that result in a new partnering game and method of playing same which is not anticipated, rendered obvious, suggested, or even implied by any of the prior art games, either alone or in any combination thereof.

It is another object of the present invention to provide a new partnering game and method of playing same which may be easily and efficiently manufactured and marketed.

It is a further object of the present invention to provide a new partnering game and method of playing same which is of a durable and reliable construction.

An even further object of the present invention is to provide a new partnering game and method of playing same which is susceptible of a low cost of manufacture with regard to both materials and labor, and which accordingly is then susceptible of low prices of sale to the consuming public, thereby making such partnering game and method of playing same economically available to the buying public.

Still another object of the present invention is to provide a new partnering game and method of playing same for enabling male and female players to anonymously select a player of their liking and determining whether or not the selected player likes them in such manner that only a mutually self-selected male-female couple knows of the selection.

Still yet another object of the present invention is to provide a new partnering game and method of playing same for enabling male and female players to determine the existence and number of admirers he or she has.

Still another object of the present invention is to provide a new partnering game and method of playing same for enabling male and female players to determine the overall attractiveness he or she has as seen by the opposite sex.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 17 thereof, a new partnering game and method of playing same embodying the principles and concepts of the present invention will be described.

Figure 1:
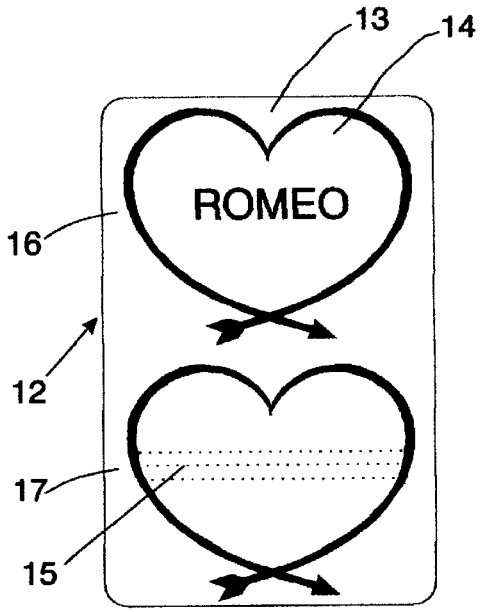
FIG. 1 is a plan view of a representative card of a first set of cards.
Figure 2:
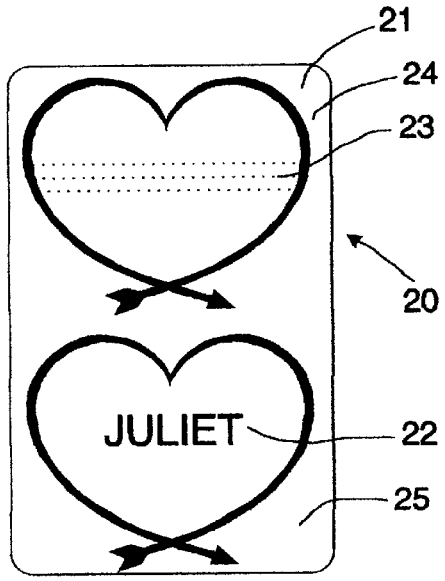
FIG. 2 is a plan view of a representative card of a second set of cards.
Figure 3:
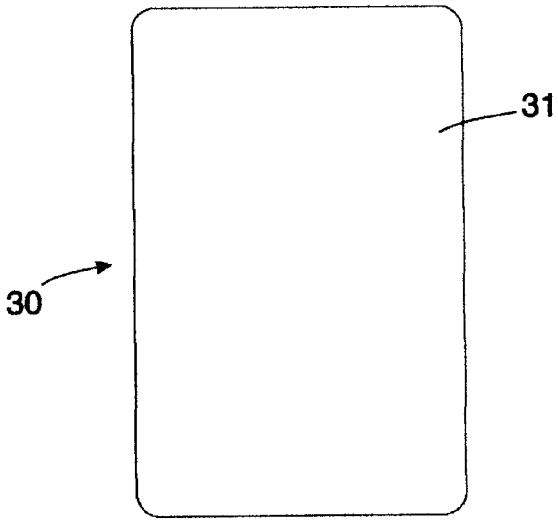
FIG. 3 is a plan view of a representative card of a third set of cards.

With reference to FIGS. 1–3, a preferred embodiment of the partnering game is shown including a representative card 12 of a first set of cards, hereinafter referred to as male private cards, a representative card 20 of a second set of cards, hereinafter referred to as female private cards, and a representative card 30 of a third set of cards, hereinafter referred to as bluff cards. The male private card 12 includes a front side 13 upon which are shown disposed an indicia 14 from a first set of indicia, which in the preferred embodiment include the names of males, and a selection portion 15 including a dot matrix consisting of ten adjoining 3×3 dot matrices. The indicia 14 is shown disposed upon the front side 13 in a male private card top portion 16 and the selection portion 15 is shown disposed upon the front side 13 in a male private card bottom portion 17. The cards of a fourth set of cards are identical to the male private cards in every respect.

The female private card 20 is shown including a front side 21 upon which is disposed an indicia 22 from a second set of indicia, which in the preferred embodiment include the names of the female counterparts of the male indicia such as Juliet/Romeo and Eve/Adam. A selection portion 23 includes a dot matrix consisting of ten adjoining 3×3 dot matrices. The indicia 22 is disposed upon the front side 23 in a female private card bottom portion 25 and the selection portion 23 is disposed upon the front side 23 in a female private card top portion 24. The cards of a fifth set of cards are identical to the female private cards of in every respect.

A back side of the male private card 12, a back side of the female private card 20, and a back side of the bluff card 30 are identical one to the other and include a decorative design (not shown). The male private card 12, the female private card 20, and the bluff card 30 are dimensionally identical and made from a material having a smooth and firm surface. The bluff card 30 is shown having a blank first face 31.

To play the partnering game with the five sets of cards, a play area is selected, such as a table top and the players position themselves around the play area. A host for the game, who may also be a player, is selected. The game is preferably played by an equal number of male and female players, there being preferably at least three male players and three female players to ensure anonymity.

The host of the game forms three decks of cards from the five sets of cards by shuffling the male private cards and inserting behind each male private card the identical card from the fourth set of cards thereby forming a first deck of cards. A second deck of cards is formed by shuffling the female private cards and inserting behind each female private card the identical card from the fifth set of cards. A third deck of cards includes the bluff cards.

Each player is given two identical cards from the first deck if the player is male and two identical cards from the second deck if the player is female. Additionally, each player is given a plurality of cards from the third deck, the number being determined by dividing the number of players by two, squaring the result, and subtracting one from the squared result. Thus, by way of example, if five male players and five female players are playing the partnering game, each player is given twenty four cards from the third deck. All of the cards are given to the players such that the back sides of the cards having the decorative design are showing.

Each player then holds in their hand, in such manner that the other players cannot see the front sides of the cards, a plurality of cards equal to the number of players of the opposite sex playing the game. The cards held by each player include the card from the male private cards if the player is male, or the card from the female private cards if the player is female, complemented by a plurality of cards from the set of bluff cards.

Each male player memorizes the indicia appearing on his male private card. In like manner, each female player memorizes the indicia appearing on her female private card.

Each male player then selects a female player of his liking and positions his male private card in such manner that when the cards held in his hand are dealt to the female players, the male private card is dealt to the selected female player. In similar fashion, each female player selects a male player of her liking and positions her female private card in such manner that when the cards held in her hand are dealt to the male players, the female private card is dealt to the selected male player.

Each male player deals out the cards held in his hand to the female players as described above and in similar fashion, each female deals out the cards held in her hand to the male players. Each player then has a new set of cards.

The male players then give the host of the game their card from the fourth set of cards and the female players give the host their card from the fifth set of cards in such manner that the players do not see the front side of the cards. The host shuffles and arranges the cards from the fourth set of cards into a matrix column heading row and the cards from the fifth set of cards into the matrix row heading column. Each male players arranges his new set of cards with his remaining bluff cards in such manner that upon placing one card in each matrix cell front side down any female private cards received from a female player are positionable in the matrix in the column corresponding to his card from the fourth set of cards and the row corresponding to the indicia of the female private card. In similar fashion, each female player arranges her new set of cards with her remaining bluff cards in such manner that upon placing one card in each matrix cell front side down any male private cards received from a male player are positionable in the matrix in the row corresponding to her card from the fifth set of cards and the column corresponding to the indicia of the male private card.

The host of the game then shuffles the cards front side down in each matrix cell, sorts the cards front side up to reveal any male or female private cards, and places any such cards back in the matrix cell.

Any matrix cell having a pair of cards reveals a mutual attraction and any matrix cell having only one card reveals an admirer of the player in whose row or column the card appears.

In another preferred embodiment of the partnering game, the male players arrange themselves about the play area in a line so that each male player represents a matrix column heading. In similar fashion, the female players arrange themselves about the play area in a line so that each female player represents a matrix row heading. The host of the game forms three decks of cards from the five sets of cards by shuffling the male private cards and inserting behind each male private card the identical card from the fourth set of cards thereby forming a first deck of cards. A second deck of cards is formed by shuffling the female private cards and inserting behind each female private card the identical card from the fifth set of cards. A third deck of cards includes the bluff cards.

Each player is given two identical cards from the first deck if the player is male and two identical cards from the second deck if the player is female. Additionally, each player is given a plurality of cards from the third deck, each male player receiving from the third deck one card less than the number of male players playing the game and each female player receiving from the third deck one card less than the number of female players playing the game. Thus, by way of example, if five male players and four female players are playing the partnering game, each male player is given four cards from the third deck and each female player is given three cards from the third deck. All of the cards are given to the players such that the back sides of the cards having the decorative design are showing.

Each player then hides his or her card from the fourth or fifth set of cards for subsequent use in the game.

Each male player memorizes the indicia appearing on his male private card. In like manner, each female player memorizes the indicia appearing on her female private card.

Each male player then selects a female player of his liking and positions his male private card in such manner that when the cards held in his hand are positioned in the matrix cells corresponding to his column, the male private card is positioned in the row corresponding to the female player of his liking. In similar fashion, each female player selects a male player of her liking and positions her female private card in such manner that when the cards held in her hand are positioned in the matrix cells corresponding to her row, the female private card is positioned in the column corresponding to the male player of her liking.

In a first mode of play designed to reveal only mutual attractions, each male and female player then positions, back side up, his or her cards in the matrix cells, each matrix cells containing two cards. The host of the game then randomly picks up each two card stack, back side up, to form a deck in his hand. The host then randomly places, back side up, each two card stack back in the matrix cells.

With the removal by the host of all of the bluff cards from each two card stack, any stack containing two cards reveals or confirms a mutual attraction between the male and female players whose indicia appear on the cards.

Alternatively, in a second mode of play designed to reveal both mutual attractions and admirers, each male player picks up all of the cards in the matrix cells corresponding to his column back side up in such manner that the order of two card stacks is not destroyed, as by first picking up the two card stack closest to himself and progressing in a direction away from himself. To the top of each resulting deck, each male player adds his card from the fourth set of cards back side up and binds the stack as with a rubber band. The host collects the stacks from the male players, shuffles the stacks and returns a stack to each male player.

Each male player removes the top card from his deck and places it front side up in front of him and then places each two card stack front side down in the matrix cells corresponding to each female player in his column.

In similar fashion, each female player picks up all of the cards in the matrix cells corresponding to her row back side up in such manner that the order of two card stacks is not destroyed, as by first picking up the two card stack closest to herself and progressing in a direction away from herself. To the top of each resulting deck, each female player adds her card from the fifth set of cards back side up and binds the stack as with a rubber band. The host collects the stacks from the female players, shuffles the stacks and returns a stack to each female player.

Each female player removes the top card from her deck and places it front side up in front of her and then places each two card stack front side down in the matrix cells corresponding to each male player in her row.

The host of the game then removes from each two card stack all of the cards from the third set of cards. Any two card stack confirms or reveals a mutual attraction and any matrix cell having one card reveals an admirer to the person designated by the indicia of the column or row the card appears in.

In another preferred embodiment of the partnering game, the host of the game forms three decks of cards from the five sets of cards by shuffling the male private cards thereby forming a first deck of cards. A second deck of cards is formed by shuffling the female private cards. A third deck of cards includes the bluff cards.

Each male player is given a male private card from the first deck of cards and each female player is given a female private card from the second deck of cards. Each male player memorizes the indicia appearing on his male private card. In like manner, each female player memorizes the indicia appearing on her female private card. Additionally, each player is given a plurality of cards from the third deck of cards, each male player receiving from the third deck one card less than the number of male players playing the game and each female player receiving from the third deck one card less than the number of female players playing the game. Each player holds his or her cards in such manner that the other players cannot see the front sides of the cards.

Each male player then selects a female player of his liking and positions his male private card in such manner that when the cards held in his hand are dealt to the female players, the male private card is dealt to the selected female player. In similar fashion, each female player selects a male player of her liking and positions her female private card in such manner that when the cards held in her hand are dealt to the male players, the female private card is dealt to the selected male player.

After the cards are dealt by the male and female players, each player has a new hand consisting of five cards which may or may not include a male or female private card. Each player then sorts through their hand and retrieves all female private cards if the player is male, and all male private cards, if the player is female. Each player then writes their memorized indicia upon the selection portion of each retrieved card with an erasable marker in such manner that the other players cannot see the marked indicia. If a player does not retrieve a male or female private card from his or her hand, he or she must bluff that he or she is writing their indicia upon a card.

Each player then places their hand front side down in the center of the play area. The host of the game then shuffles the stack front side down and then with the front sides showing, removes all the cards from the third set of cards. The host further sorts out any two cards sharing identical indicia thereon. Two such coupled cards confirm or reveal a mutual attraction between the male and female player corresponding to the indicia. Any non-coupled male or female private cards reveal admirers of the player whose indicia appears in the selection portion of the card.

For each of the above variations of the partnering game, the occurrence of a pairing of indicia corresponding to a famous couple, such as Romeo and Juliet, reveals a "magical" match. This type of match is "magical" because it is a rare occurrence.

With reference to FIGS. 4–13, another preferred embodiment of the partnering game includes a hand held device 40 including a housing 41 having a front portion 42, a left side portion 43, a right side portion 44, a back portion 45, and a top portion 46 shown including a slot 78 for accessing a bar code reader. The front portion further includes a keypad 47 having ten keys 48, a speaker and speaker grill 49, and a display means 50. The left side portion 43 is shown including an on/off switch and volume control means 51. The right side portion 44 includes a phono jack 52. A battery compartment 53 is shown disposed in the back portion 45 for receiving a plurality of batteries to power the circuitry (not shown) disposed within the housing 41.

The circuitry includes a microprocessor operably coupled to a read only memory device (ROM) for storing a computer program, the function of which will be described below. A random access memory device (RAM) is also operably coupled to the microprocessor and functions to store program variables. A non volatile random access memory device (NV RAM) is operably coupled to the microprocessor for storing values generated by the program which are permanently saved in case of device turn-off or battery failure until reset to new values as hereinafter described. A data input means and a data output means are operably coupled to the microprocessor for performing standard data input and output functions.

The data input means include a first data input means including the numeric key pad 47 having ten keys 48. The keys 48 are used to enter selections and control codes as described below. A second data input means includes a conventional LED/photodiode bar code reader for reading an eight bit binary bar code. Four input cards 60, 62, 70, and 76 are shown in FIGS. 10–13 and are receivable in the bar code reader through a slot 78 formed in the bottom portion of the housing 41.

Figures 4, 5, 6, 7, 8:
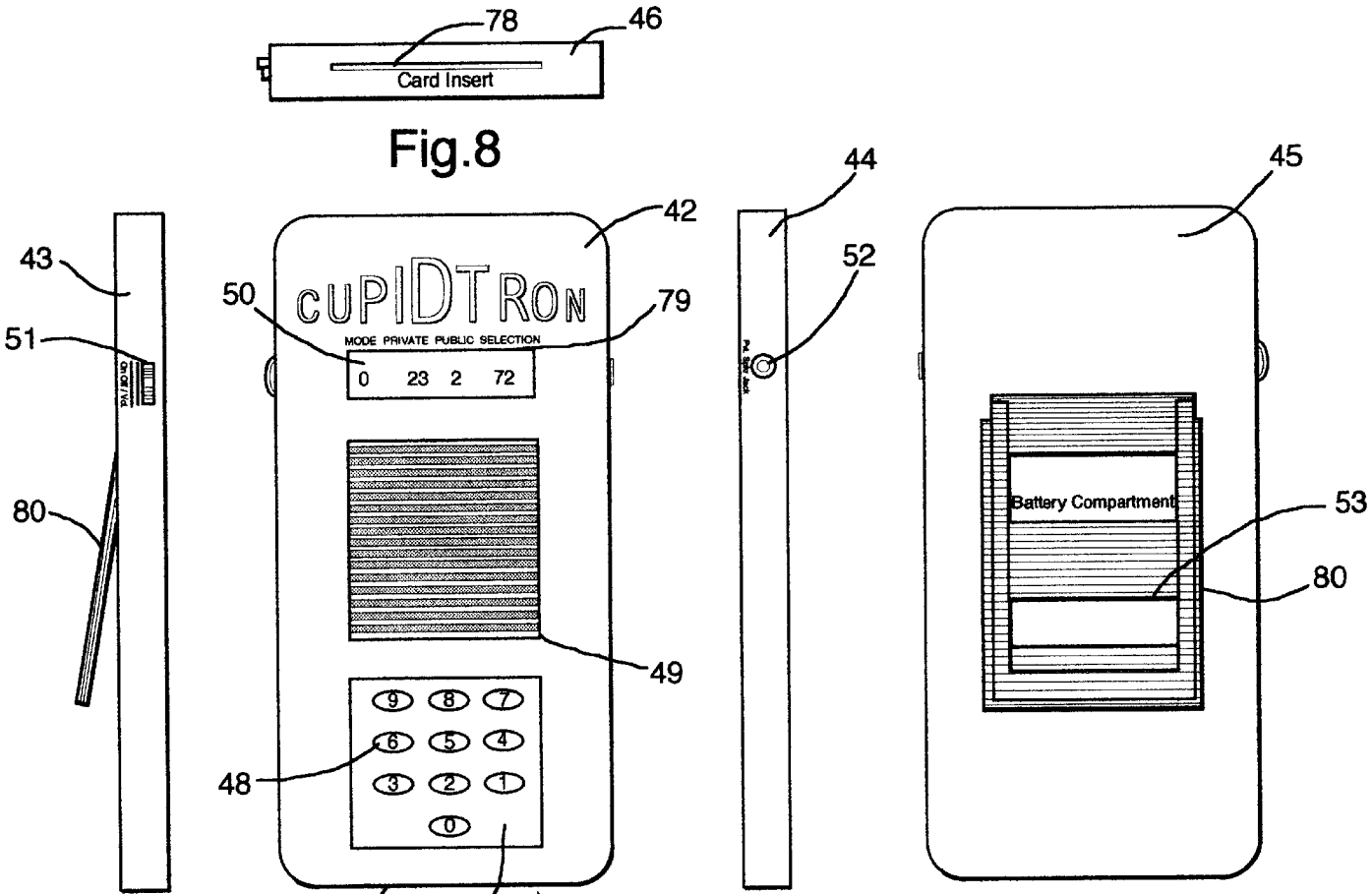
FIG. 4 is a front elevational view of the hand held device of the present invention.
FIG. 5 is a rear elevational view of the hand held device of the present invention.
FIG. 6 is a left side elevational view of the hand held device of the present invention.
FIG. 7 is a right elevational view of the hand held device of the present invention.
FIG. 8 is a top elevational view of the hand held device of the present invention.
Figure 9:
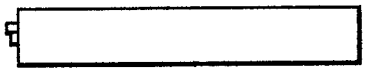
FIG. 9 is a top elevational view of an alternative embodiment of the hand held device of the present invention.

The data output means include a first data output means including a display screen 50 such a liquid crystal display (LCD). The display screen 50 is capable of displaying four distinct alphanumeric characters under four headings 79 as shown in FIG. 4. A second data output means includes an audio speaker operably coupled to a sound synthesis device which is in turn operably coupled to the microprocessor. The phono jack 52 is operably coupled to the sound synthesis device for outputting an audio signal to an external speaker.

A stand 80 of conventional design is shown in FIGS. 5 and 6 for propping the housing 41 at an inclined angle upon a flat surface.

Figure 10:
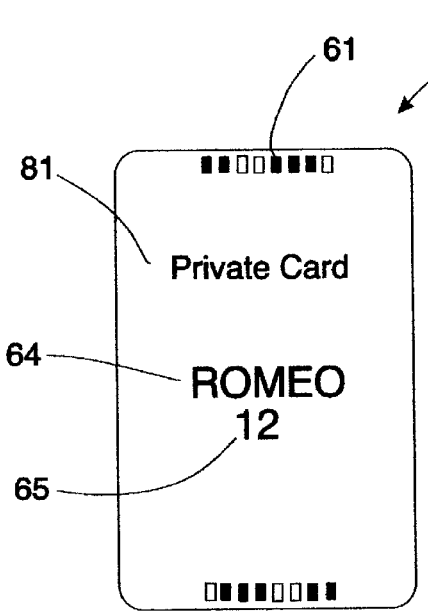
FIG. 10 is a front elevational view of a male input card of the present invention.

With reference to FIG. 10, a representative male input card 60 is shown including an indicia 64 from a first set of indicia upon a front side of the card for identifying a male player of the game. The male input card 60 further includes a number 65 upon the front side of the card and a pair of corresponding bar codes 61 having the eighth bit set to one. The male input card 60 further includes the indicia "Private Card" 81 upon the front side of the card to indicate it's function as will be further described hereinafter. The game includes a plurality of male input cards 60 having different indicia 64.

Figure 11:
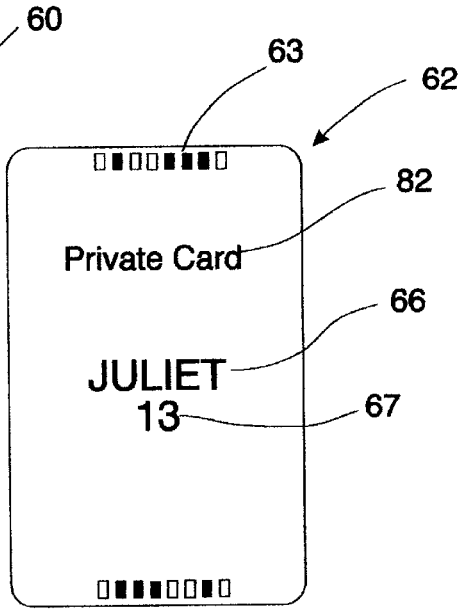
FIG. 11 is a front elevational view of a female input card of the present invention.

With reference to FIG. 11 a female input card 62 is shown including an indicia 66 from a second set of indicia upon a front side of the female input card for identifying a female player of the game. The female input card 62 further includes a number 67 upon the front side of the card and a pair of corresponding bar codes 63 having the eighth bit set to one. The female input card 62 further includes the indicia "Private Card" 82 upon the first face of the card to indicate it's function as will be further described hereinafter. The game includes a plurality of female input cards 60 having different indicia 66. The first set of indicia include the male names from a set of famous couples and the second set of indicia include the female names corresponding to the male names.

Figure 12:
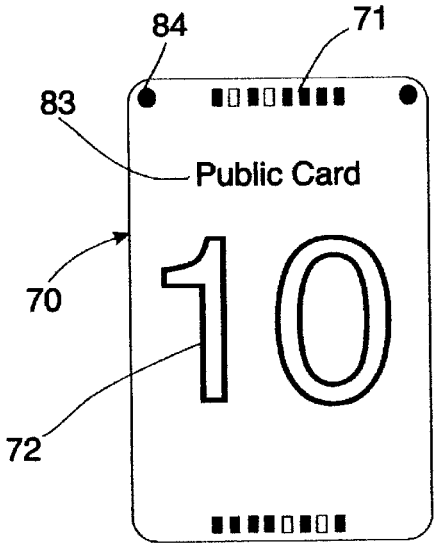
FIG. 12 is a front elevational view of a public card of the present invention.

With reference to FIG. 12, a means for giving the game players a public identity is shown including a card 70 having the indicia "Public Card" 83 upon a first face thereof. The card 70 further includes a number 72 for publicly identifying the player and an eight bit bar code 71 corresponding thereto, the eighth bit being set to zero. The card 70 is further shown including a pair of apertures 84 formed at opposite corners for receiving a string. In use the player puts the string around his or her neck to display the card 70. The game includes a plurality of cards 70 totaling the sum of the plurality of male and female cards 60 and 62.

Figure 13:
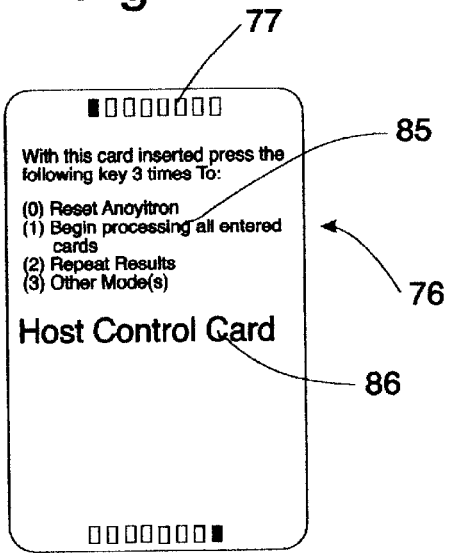
FIG. 13 is a front elevational view of a host control card of the present invention.

With reference to FIG. 13, there is shown a card 76 including an indicia "Host Control Card" 86 upon a front side thereof. The card 76 also includes a set of instructions 85 for it's use. The card 76 further includes an eight bit bar code 77 set to the numeral 254. The microprocessor firmware includes a means for decoding this numeral and entering into a control mode. In this mode the host of the game can reset the microprocessor by entering a first unique code upon the key pad, process male and female input cards entered during the course of a game by entering a second unique code upon the key pad, or enter other control commands as further described hereinafter.

As in the previously described embodiments of the partnering game, the hand held device provides a means by which players that may have a mutual attraction to each other can confirm this attraction with total anonymity.

To play the partnering game, the hand held device is placed in a location where all the players can see it. In the preferred embodiment, an equal number of male and female players play the game and at least three players of each sex play. A host of the game is selected who may also be a player.

The host of the game shuffles all of the male Private Cards 60 to form a first deck of cards and all of the female Private Cards 62 to form a second deck of cards. The host additionally shuffles all of the Public Cards 70 to form a third deck of cards. Each male player is dealt one male Private Card 60 and one Public Card 70 which he hangs around his neck. Each female player is dealt one female Private Card 62 and one Public Card 70 which she hangs around her neck.

Each player then selects a player of the opposite sex of their liking. A first player inserts their Private Card 60,62 into the bar code reader through slot 78 and removes it when the number appearing on the card appears on the display screen 50. The player then inserts his or her Public Card 70 into the bar code reader and when the number appearing on the Public Card 70 appears on the display screen 50, the player enters a selection number corresponding to the number appearing on the Public Card 70 of the player he or she has selected. The microprocessor includes firmware for processing and forming a triplet of numbers including a private number corresponding to the number appearing on the Private Card 60,62, a public number corresponding to the number appearing on the Public Card 70 and the selection number.

Each player in turn performs the steps of inserting and removing their Private Card 60,62, inserting their Public Card 70 and entering the number appearing on the Public Card 70 of the player selected. The microprocessor firmware matches the triplets of each player in such manner that a first triplet corresponding to a first player is compared to all other triplets, a second triplet is compared to all other triplets excluding the first triplet, a third triplet is compared to all other triplets excluding the first and second triplets, this comparison being repeated until all triplets are compared to each other. The firmware compares the selection number of a first triplet to the public number of a second triplet and then compares the selection number of the second triplet to the public number of the first triplet. If both comparisons match, the two triplets indicate a reciprocal selection and the triplets are stored by the microprocessor. The firmware performs the comparisons for each pair of triplets and stores all reciprocal selections. The firmware of the game is such that the names of famous couples are encoded into sequential private numbers and a "magical couple" can be determined by subtracting the private numbers of all reciprocal selections and flagging a "magical couple" when the difference between the private numbers is one or minus one.

The matches found are outputted to the speaker 49 by announcing the private names of the matched players. Additionally, any "magical couple" is indicated in the announcement.

The firmware further includes a means for determining the number of admirers of each player. The firmware performs a tally/sort comparison by comparing the selection number of each triplet to the selection number of all the other triplets. When a match is found, a unilateral attraction is established and the microprocessor increments an admirer count for the triplet being compared. The firmware then sorts the triplets in such manner that the triplet with the highest admirer count is placed first in an admirer list.

The private names and corresponding admirer counts of all players having admirers are then outputted to the speaker 49 and announced.

If the partnering game is played by the same players a plurality of times, new admirers may be revealed in successive rounds.

The host of the game then may cause the device to repeat the matched selections and admirer counts by means of the Host Control Card. The matches found and the admirer counts are stored in memory until the device is reset by means of the Host Control Card.

In another preferred embodiment, the Private Cards are not utilized. In this embodiment, each player inserts a Public Card 70 into the bar code reader and the microprocessor program includes a means for randomly generating a private name for each player. The private name and the public number are outputted to the display 50 together with a prompt for the player to enter his or her selection. Each player memorizes his or her private name and enters the selection using the key pad. By removing the Public Card 70 the selection is stored in memory. These steps are repeated by each player and the microprocessor runs the same programs described hereinabove.

Figure 14:
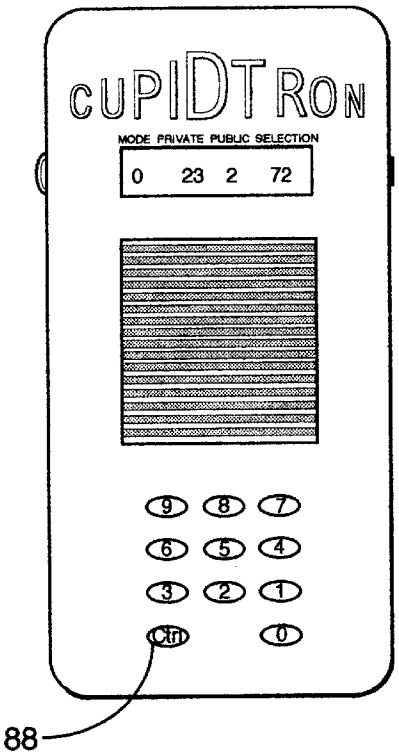
FIG. 14 is a front elevational view of an alternative embodiment of the hand held device of the present invention.

In another preferred embodiment, the slot 78 (FIG. 9), and the cards 60, 62, and 76 are not included. In this embodiment, a control key 88 is provided (FIG. 14). Pressing the control key 88 once places the device in a selection/entry mode. In this mode, each player enters his or her public number and his or her selection. The microprocessor program includes a means for generating a random and exclusive private number and private name for each public number entered by each player. After entering his or her public number and his or her selection and memorizing his or her generated private name, each player again presses the control key 88 to enable the next player to enter his or her public number and selection. Pressing the control key 88 twice places the device in an action mode. In this mode, pressing the "1" key three times, the host of the game enables the microprocessor program to announce the reciprocal matches and admirer counts.

In another preferred embodiment, a thermal printer is operably coupled to the microprocessor. The thermal printer is operable to print a receipt of the private name/private number.

In still another preferred embodiment, video output circuitry is operably coupled to the microprocessor for displaying matches and admirer tallies as graphics on video screens.

In another preferred embodiment, additional microprocessor functions to include time and date functions, dictionary functions, and calculator functions are included in the firmware.

In another preferred embodiment, a device 90 having the shape of a watch includes housing 91 having a liquid crystal display screen 92 disposed adjacent headings 99, an infrared light emitting diode 94, an infrared sensor 93 in a directional sensor hole, and three control buttons 95–97. The device is operational in a first mode wherein it operates as a conventional watch and in a second mode wherein it operates as the partnering game. In the second mode the infrared light emitting diode 94 broadcasts an infrared signal which contains the private number of the device and a selection number, if a selection has been made. The transmission range of the light emitting diode is fifteen feet or greater.

When the device is initially powered up, a microprocessor program generates a random private number within the range of 1 to 999. This code is saved permanently until the watch is powered off, as in the case where the batteries are replaced. If the device encounters another device having the same private number, the microprocessor program generates another private number unique within the range of the device.

Figure 17:
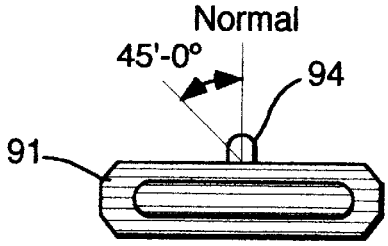
FIG. 17 is a partial side elevational view of the alternative embodiment of the present invention.

As shown in FIG. 17, a zone within which the device is able to transmit to other similar devices is maximized by providing that the transmission span the plane of the watch face and span from 67.5 to 90 degrees from the normal to the watch face.

The infrared sensor 93 is shown disposed at the end of a hole formed in a side portion of the watch. The front of the hole is covered by a conventional infrared filter which absorbs visible light but is transparent to infrared light. Upon the receipt of an infrared signal from a similar device, the microprocessor of the device runs the programs of the partnering game as previously described.

In the second mode of operation the liquid crystal display screen 92 under the three headings 99 is capable of displaying a participant count by means of the hours numeral in the first mode, a numeral representing the number of participants that have selected another player by means of the minutes numeral in the first mode, a numeral representing the number of admirers of the watch wearer by means of the second numeral in the first mode, and a graphic of a heart 98 to indicate that selection of a participant is permissible in which case the graphic is lit or verification of a match in which case the graphic blinks.

Figure 15:
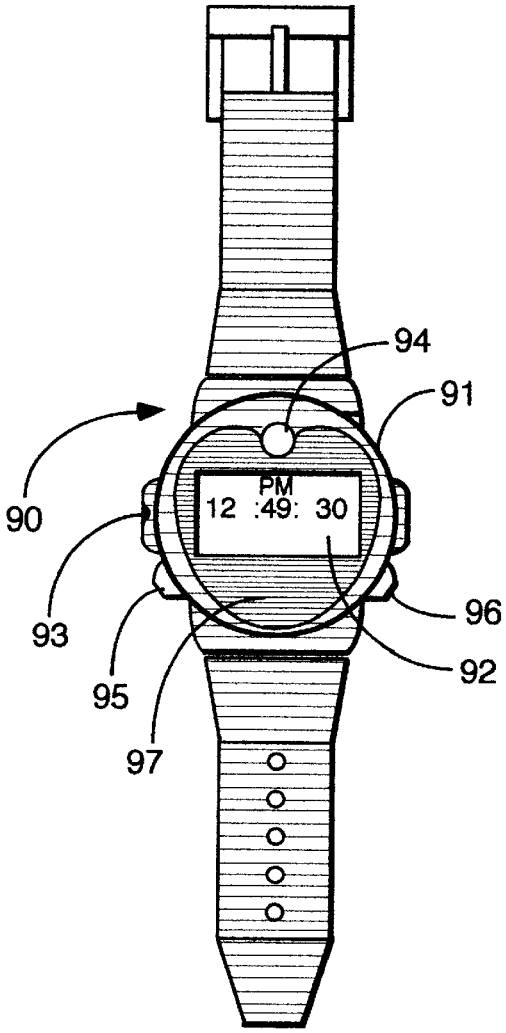
FIG. 15 is a front elevational view of an alternative embodiment of the present invention in a watch mode.
Figure 16:
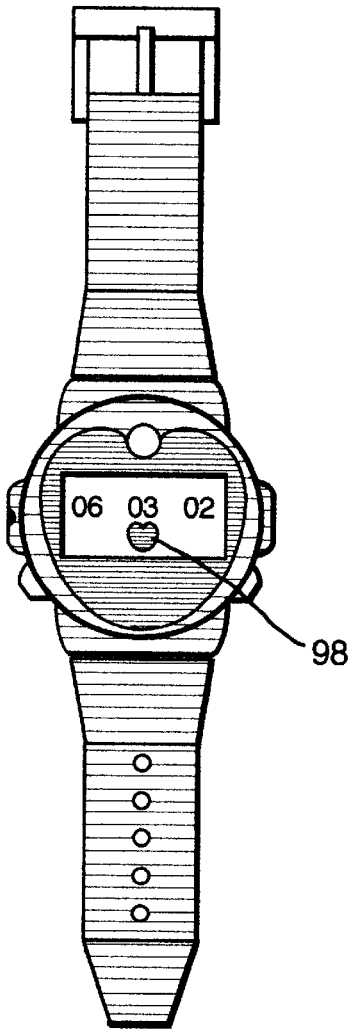
FIG. 16 is a front elevational view of the alternative embodiment of the present invention in a game playing mode.

Three control buttons 95–97 are shown in FIGS. 15 and 16 and include a mode button 95, an adjust button 96, and a selection/settings button 97. The adjust button 96 is used by in the first mode to adjust the time setting. The selection/settings button 97 in the first mode is used to select which time setting to adjust. In the second mode, the selection/settings button 97 enables a player to select a player of the opposite sex.

In the second mode of operation, the liquid crystal display 92 clears and the infrared light emitting diode 94 is operative and continuously transmits an infrared pulse. When three or more females and three or more males having the device set to the second mode of operation enter the range of the devices, each device will vibrate or beep once and display the number of participants within it's range. If a player directs his or her watch at another player of the opposite sex, the graphic 98 will appear on the display 92. If the player presses the selection button 97 while the graphic 98 is displayed, the player in whose direction the watch is directed is selected. The position of the player selected acts as the public number of the previously described embodiments. The selection of the player selected will appear on the display 92 of the person selected under an admirer heading. If other players select the same player the total number of admirers is displayed. The selection will also appear on all devices under a selectors heading. In the event of a mutual selection, the graphic 98 will blink indicating the mutual selection.

To play the partnering game, each player scans the other players of the opposite sex by moving their devices in a continuous horizontal arc. Each player presses their selection button when the graphic indicator appears on the screen of their device in response to the device being directed at a player being selected. Each player must perform bluff scans to insure that no one can detect their selection.

As the players make their selections, all the devices simultaneously display the updated admirer count and selector count. If there are any reciprocal matches, blinking graphics 98 are displayed on the watches of the matched participants only. When the selector count equals the participant count, the game is over. The devices will then reset the selector count and admirer count to zero to await the start of another game or round.

In another preferred embodiment of the invention, a radio-frequency transmitter/receiver means transmits and receives the signal that contains the private number. Selection of another player is accomplished through infrared signaling as previously described.

For each of the above preferred embodiments of the partnering game, a male or female player can determine his or her overall attractiveness by tracking the overall number of admirers and matches obtained over the course of playing the game successive times.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of playing a partnering game comprising the steps of:

providing a microprocessor operably coupled to a read only memory device, a random access memory device, a non volatile random access memory device, bar code reader, a keyboard input means, and a data output means;

providing a plurality of male data input cards having disposed thereon a first indicia from a first set of indicia, a first numeral, a first bar code representative of the first numeral, and a second indicia representative of the use of the card;

providing a plurality of female data input cards having disposed thereon a first indicia from a second set of indicia, a second numeral, a second bar code representative of the second numeral, and a second indicia representative of the use of the card;

providing a plurality of identity cards having disposed thereon a third numeral, a bar code representative of the third numeral, and a third indicia representative of the use of the card; forming a first deck of cards by shuffling the male data input cards;

forming a second deck of cards by shuffling the female data input cards;

forming a third deck of cards by shuffling the identity cards;

dealing to each male player a card from the first deck of cards;

dealing to each female player a card from the second deck of cards;

dealing to each male and female player a card from the third deck of cards, each player displaying the card from the third deck of cards;

having each male player select a female player of his liking;

having each female player select a male player of her liking;

sequentially having each player insert his card from the first or second deck into the bar code reader, the microprocessor having means for displaying the first and second numerals by means of the output means, the player then inserting his card from the third deck into the bar code reader, the microprocessor having means for displaying the third numeral by means of the output means, and having the player enter a selection number corresponding to the third numeral of the card dealt to the member of the opposite sex of his liking by means of the keyboard;

providing the microprocessor with means for forming a triplet of numbers representing each player's first numeral, second numeral and the selection number;

providing the microprocessor with means for sequentially comparing the triplets to select any reciprocal selections; and providing the microprocessor with means for displaying any such reciprocal selections.

2. A method as recited in claim 1 wherein the means for displaying the reciprocal selections further comprise a speaker operably coupled to the microprocessor.

3. A method as recited in claim 1 further comprising the steps of providing the microprocessor with means for performing a tally/sort comparison, the tally/sort comparison comprising comparing the selection number of each triplet to the selection number of all other triplets, keeping an admirer count for each triplet corresponding to the number of selection number matches, and outputting the admirer counts.

4. A method of playing a partnering game comprising the steps of: providing a microprocessor operably coupled to a read only memory device, a random access memory device, a non volatile random access memory device, bar code reader, a keyboard input means, and a data output means; providing a plurality of identity cards having disposed thereon a first numeral, a bar code representative of the first numeral, and a first indicia representative of the use of the card;

dealing to each male and female player one of the plurality of identity cards, each player displaying his identity card; having each male player select a female player of his liking;

having each female player select a male player of her liking;

sequentially having each player insert his identity card into the bar code reader, the microprocessor having means for randomly generating a private name for the player and displaying the first numeral and private name by means of the output means, prompting the player to enter a selection number corresponding to the first numeral of the identity card of the player selected, each player memorizing his private name and entering the selection number using the keyboard;

providing the microprocessor with means for forming a triplet of numbers representing each player's first numeral, private name and selection number;

providing the microprocessor with means for sequentially comparing the triplets to select any reciprocal selections; and providing the microprocessor with means for displaying any such reciprocal selections.

5. A method as recited in claim 4 wherein the means for displaying the reciprocal selections further comprise a speaker operably coupled to the microprocessor.

6. A method as recited in claim 4 further comprising the steps of providing the microprocessor with means for performing a tally/sort comparison, the tally/sort comparison comprising comparing the selection number of each triplet to the selection number of all other triplets, keeping an admirer count for each triplet corresponding to the number of selection number matches, and outputting the admirer counts.

7. A method of playing a partnering game comprising the steps of: providing a microprocessor operably coupled to a read only memory device, a random access memory device, a non volatile random access memory device, a keyboard input means, and a data output means;

providing a plurality of identity cards having disposed thereon a first numeral and a first indicia representative of the use of the card;

dealing to each male and female player one of the plurality of identity cards, each player displaying his identity card;

having each player sequentially input his first numeral and a selection number corresponding to the first numeral of the selected player, the microprocessor having means for generating a random and exclusive number and a private name for the player;

providing the microprocessor with means for forming a triplet of numbers representing each player's first numeral, private name and selection number;

providing the microprocessor with means for sequentially comparing the triplets to select any reciprocal selections; and providing the microprocessor with means for displaying any such reciprocal selections.

8. A method as recited in claim 7 wherein the means for displaying the reciprocal selections further comprise a speaker operably coupled to the microprocessor.

9. A method as recited in claim 7 further comprising the steps of providing the microprocessor with means for performing a tally/sort comparison, the tally/sort comparison comprising comparing the selection number of each triplet to the selection number of all other triplets, keeping an admirer count for each triplet corresponding to the number of selection number matches, and outputting the admirer counts.

10. A method of playing a partnering game comprising the steps of:

providing a plurality of game units, each game unit having a microprocessor operably coupled to a read only memory device, a random access memory device, a non volatile random access memory device, an input means, and a data output means;

providing a sensor operably coupled to the microprocessor, the sensor for sensing a transmission; providing a transmitter operably coupled to the microprocessor;

providing the microprocessor with means for generating a random private number;

providing a game unit to each of a plurality of male and female players;

having each player select a player of the opposite sex of their liking;

having each player direct the transmitter to the selected player and transmit a signal to the respective sensor of the game unit of the selected player representing a selection, the signal including the private number of the player;

each respective microprocessor having means for displaying and updating an admirer count on each game unit representative of the number of players signaling a selection to the game unit and means for displaying a mutual selection.

* * * * *